US006679994B1

(12) United States Patent
Turco et al.

(10) Patent No.: US 6,679,994 B1
(45) Date of Patent: Jan. 20, 2004

(54) SCREENING APPARATUS

(75) Inventors: Joe Turco, 27 Moorilla Avenue, Carlingford, New South Wales 2118 (AU); Eugene Turco, 45 Pinetree Drive, Carlingford, New South Australia 2118 (AU); Ross Douglas Vernon King, Killara (AU)

(73) Assignees: Joe Turco, Carlingford (AU); Eugene Turco, Carlingford (AU)

( * ) Notice: Subject to any disclaimer, the term of this patent is extended or adjusted under 35 U.S.C. 154(b) by 0 days.

(21) Appl. No.: 09/719,718

(22) PCT Filed: Jun. 16, 1999

(86) PCT No.: PCT/AU99/00481

§ 371 (c)(1),
(2), (4) Date: Mar. 22, 2001

(87) PCT Pub. No.: WO99/66141

PCT Pub. Date: Dec. 23, 1999

(30) Foreign Application Priority Data

Jun. 17, 1998 (AU) ..... PP 4181

(51) Int. Cl.[7] ..... B01D 37/00

(52) U.S. Cl. ..... 210/767; 210/790; 210/791; 210/154; 210/155; 210/159; 210/162; 210/413

(58) Field of Search ..... 210/791, 767, 210/154, 155, 159, 162, 170, 407, 413, 790

(56) References Cited

U.S. PATENT DOCUMENTS 2,672,982 A * 3/1954 Way
4,415,462 A * 11/1983 Finch et al. ..... 210/162

FOREIGN PATENT DOCUMENTS

| | | |
|---|---|---|
| AU | 64365/96 | 3/1997 |
| AU | 64385/96 | 3/1997 |
| WO | WO 98/17875 | 4/1998 |
| WO | WO 97/31162 | 8/1998 |

* cited by examiner

*Primary Examiner*—Robert Popovics
(74) *Attorney, Agent, or Firm*—Pearne & Gordon LLP

(57) ABSTRACT

A method dealing with an overflow capacity of a fluid screening system is disclosed, the system (20) including a first screen (22) for screening objects of a first predetermined size from a fluid channel (21) the method comprising the step of: providing an ancillary screening system (23) upstream of the screen (22) and operational upon fluid within the channel (21) reaching a predetermined limit, the ancillary screening system screening objects of a second predetermined size from the fluid channel (21). The second predetermined size can be less than the first predetermined size. The ancillary screening system preferably can include a screen (23) placed substantially tangentially to the main flow of fluid within the fluid channel and includes a raking mechanism for cleaning objects lodged substantially adjacent the ancillary screening system. The output of the ancillary screening system can be interconnected to the fluid channel downstream of the first screen (22).

11 Claims, 5 Drawing Sheets

SECTION A-A

SCREENING APPARATUS

FIELD OF THE INVENTION

The present invention relates to the field of fluid screening systems and in particular, discloses an improved form of screening especially useful for screening materials from fluids in stormwater and storm overflow, water reservoirs, dams, pump stations, wastewater and water treatment plants including by-pass flows, fluid wastes and dissipation of the kinetic energy of the flows to a point where girt can be arrested etc.

BACKGROUND OF THE INVENTION

There are obviously many uses for screening systems in society. One popular use of a screening system positioned across the channel is the screening of material from a liquid stream/catchment prior to entering a receiving unit positioned downstream. Presently, known techniques rely upon a motor and geared arrangement for driving a raking mechanism (either linear or curved translation) in a vertical plane in the same plane as the screen bars which are pitched evenly and raked by tynes to collect the screenings. The rake is then driven by the motor so as to translate and thereby collect and dispose of the screenings at the end of its path in a usual manner. Alternatively, other than mechanical drives, hydraulic drive arrangements have been used.

Unfortunately, presently utilised systems have a number of disadvantages. In particular, the presently utilised systems have been found to be limited in their screening flow capacity especially during intermittent periods of abnormal loads such as heavy storms etc. The upstream liquid often backs up and breaks the sides of the channel due to the increased resistance to flow through the screen. In the case of polluted liquids this is a public health issue and breaches statute and license requirements regulated by the Environmental Protection Authority (EPA). This requires a larger size screen and respective channel/infrastructure to handle the increased screen flow thus increased costs. However, as the EPA screening requirements become more stringent, finer pitched screens are required and corresponding hydraulic difference is increased across the screen, requiring increased hydraulic differences in elevation to drive the fluid through the screen. Furthermore, the screenings capture volume is increased severely due to the finer pitched screen bars.

Another common problem is the hydraulic backwater that is created upstream of the screen may result in manhole covers being lifted off their seats due to the surcharge effect particularly in the case of gravity feed screened systems. The effects applied to screening fluids may in turn result in compromising public health and safety or provide a unit process of poor quality and efficiency.

SUMMARY OF THE INVENTION

It is therefore evident that there is a long felt need for a screening system which provides for a safer, more effective operation.

In accordance with a first aspect of the present invention, there is provided a method of dealing with an overflow capacity of a fluid screening system, the system including the first screen for screening objects of a first predetermined size from a fluid channel, the method comprising the step of: providing an ancillary screening system upstream of the screen and operational upon fluid within the channel reaching a predetermined limit, the ancillary screening system screening objects of a second predetermined size from the fluid channel.

The second predetermined size can be less than the first predetermined size.

The ancillary screening system preferably can include a screen placed substantially tangentially to the main flow of fluid within the fluid channel and includes a raking mechanism for clearing objects lodged substantially adjacent the ancillary screening system. The output of the ancillary screening system can be interconnected to the fluid channel downstream of the first screen.

In accordance with a further aspect of the present invention, there is provided an ancillary screening apparatus for screening an overflow capacity of a fluid screening system, the system including a screen for screening objects of a first predetermined size from a fluid channel, the ancillary screening apparatus including: a screening means including a second screen for screening objects of a second predetermined size from the channel upon fluid within the channel reaching a predetermined limit. The second predetermined size is preferably less than the first predetermined size.

The ancillary screening system preferably can include a raking mechanism adapted to rake the second screen so as to clear objects caught in the second screen. The screen can comprise a series of spaced apart slats and the raking mechanism preferably can include a series of tynes driven in a reciprocating manner between the slats. The raking mechanism can be located downstream of the screen. The raking mechanism preferably can include a reciprocating means comprising a gear with different offset holes located from the centre of the gear to change the stroke length of the reciprocation as the gear moves along its mating gear rack positioned parallel to the slats along the length of the screen.

The apparatus can be adapted to be located with the second screen being substantially tangential to the main flow of fluid within the fluid channel. The raking mechanism can be driven by a drive mechanism attached to an electrical actuator with the raking mechanism attached to the drive mechanism at the top and bottom of the screen. The drive mechanism preferably can include a belt drive, chain drive or worm drive.

In accordance with a further aspect of the present invention, there is provided a screening arrangement for screening fluids comprising of the frame and screen bars however, the screening bars stacked and pitched evenly in a horizontal position, a mechanically driven raking mechanism that translates horizontally with oscillating self-cleaning tynes that push the caught material off the screen bars. Also an optional high pressure jet sprays using re-use effluent can be installed in the tynes to assist in the cleaning of the screen bars as the oscillating tynes translates horizontally. A submersible IP68, class I zone I drive motor for driving the raking mechanism complete with travel position limit switches and overtorque device; a overtorque limiting mechanism for disengaging the raking mechanism from the drive motor when the linear force on the raking mechanism exceeds a first predetermined limit. A preset overflow weir is located above the screen in the event of power failure or overtorque activation to not inhibit the incoming flow.

Preferably, the screen bars are orientated stacked evenly in a horizontal position which are located within the frame of the screen, but installed and secured within the length of the wall upstream of the existing first screen. This allows an increase in hydraulic capacity of the existing channel and concentrates the screenings material to the existing first screen which lifts the material from the fluid stream.

The relative level of the lowest horizontal screen bar within its frame can be set to allow the liquid to divert or bypass its flow after a predetermined flow has reached the existing first screen installed across the channel. The screenings/coarse materials lie across the width of the horizontally stacked evenly pitched screenings bar while the fluids passes through.

Further, the mechanically driven raking system is positively driven by either a toothed timing belt, chain, inclined plane worm and thread type drive, but is sealed from the fluid stream. The drive is composed of a slider block that is guided within the horizontal legs of the frame and is positively located and positioned by either the timing belt, chain or inclined plane worm and thread drive. The legs supporting and transposing the raking tynes are positively secured to the slider block. The legs and frame are sealed to stop any moisture, grit or contamination entering the slider block guide chamber and frame.

The slider blocks transfer the linear motion from the drive train through to the tynes. The tynes reciprocate backwards and forwards and oscillate in a locus. The path of the locus is directly related to a gear arm arrangement in contact with a gear rack that can be changed in amplitude and pitch via the offset holes in the gear.

The kinematic path of the tynes relative to the fixed evenly pitched horizontal screen bars causes the screenings to be pushed off the screen bars as the tynes reciprocate backwards and forwards. The tynes are supported and located in a spring loaded block.

The screening arrangement can further include a lifting arrangement to remove the screen for maintenance. The screen frame houses and seals the mechanical drive and slider arrangement from contamination and is tamperproof.

The electrical drive is a standard unit complete with overtorque clutch and position limit switches. The electrical drive motor is a standard actuator fitted to the end of the drive shaft completely sealed from the elements. Further as the drive train is an electrical unit it does not create environmental problems due to the oil leaking into the water stream as a hydraulic system does.

In accordance with a further aspect of the present invention, there is provided in a screening arrangement for screening a fluid comprising of a screening frame; horizontal but vertically stacked evenly pitched screen bars, a set of raking tynes to push and remove the captured screenings; and a drive motor for driving the raking tynes via the mechanical drive belt/chain through the slider blocks with the drive belt/chain completely sealed from the contaminated liquid. The second screen providing an increased hydraulic capacity of the incoming flow and reduction in hydraulic drive head to screen a higher flow across a screen without the contaminated liquid breaking the sides of the channel. This also reduces the extra capital infrastructure cost to augment the capacity of this unit process.

BRIEF DESCRIPTION OF THE DRAWINGS

Not withstanding any other forms which may fall within the scope of the present invention, preferred forms of the scope of the present invention will now be described, by way of example only, with reference to the accompanying drawings in which.

DESCRIPTION OF PREFERRED AND OTHER EMBODIMENTS

Figure 1:
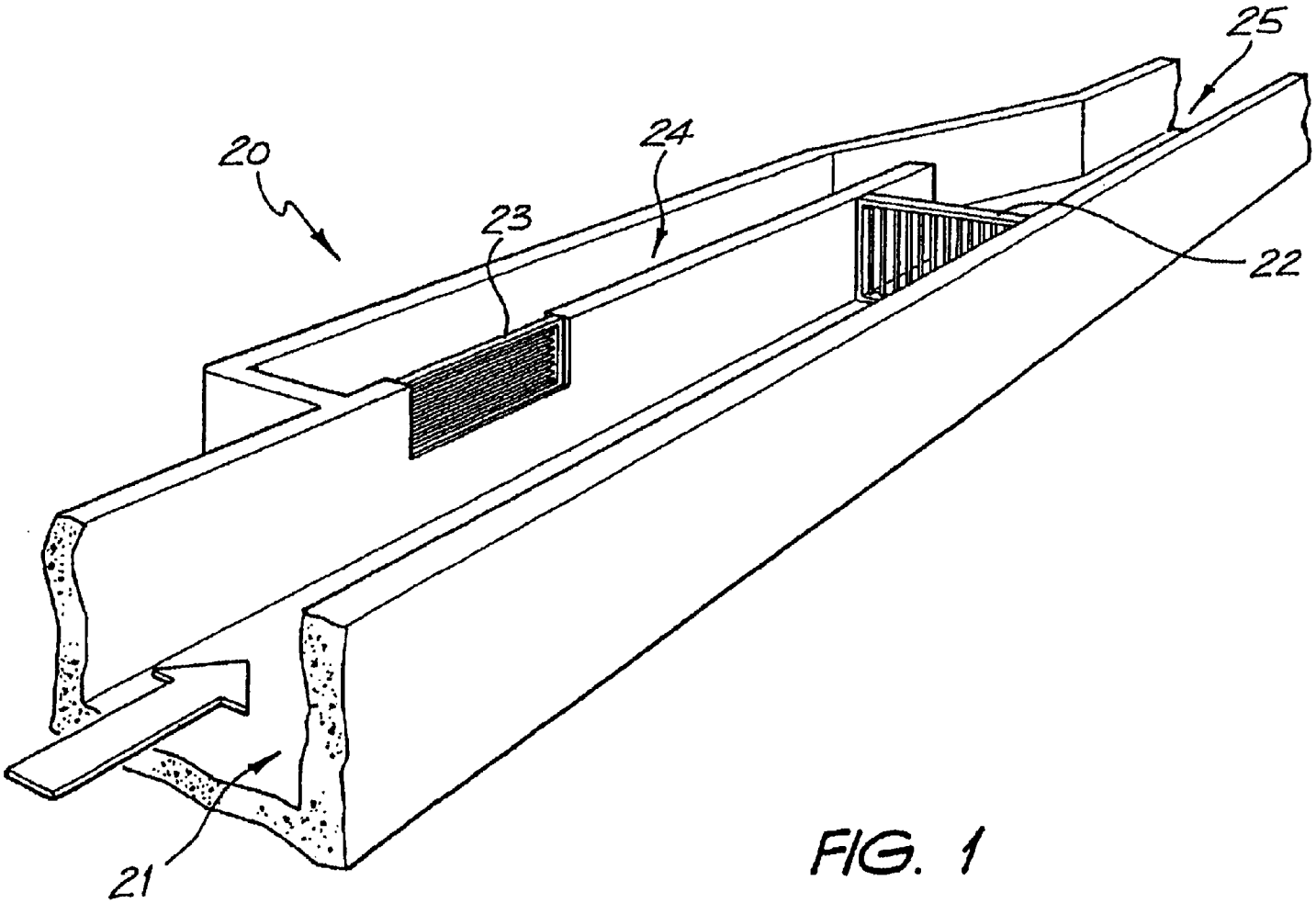
FIG. 1 illustrates an example incorporation of the preferred embodiment into a screening system.
Figure 2:
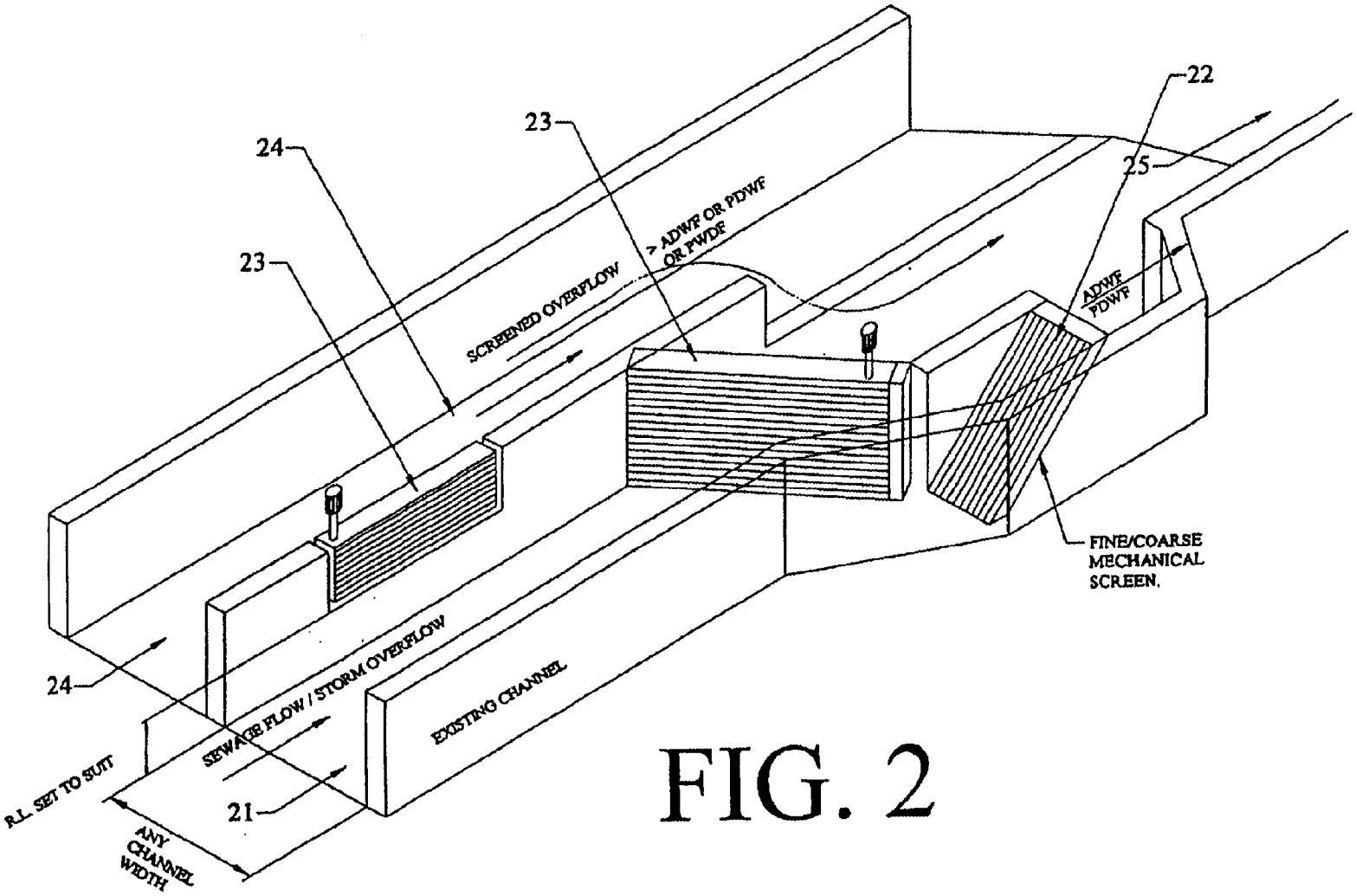
FIG. 2 illustrates another example incorporation of the preferred embodiment into a screening system

The preferred embodiment of the present invention will initially be discussed with reference to FIG. 1 and FIG. 2 which illustrates simple perspective views in sections of an example arrangement of the preferred embodiment in operation. In the example arrangement 20, a channel 21 is provided along which the material to be screened flows. The channel 21 is shown with the top removed for illustrative purposes only. Within the channel 21 there is a first screening grate 22 which is responsible for the normal operational screening of material within channel 21. The screening grate 22 can comprise a series of spaced apart bars having a pitch of approximately 2 cm. Either horizontal or vertical orientations are normally utilised. Normally, when excessive fluid flows down channel 21, a hydraulic backwater is induced in the channel 21 which results in the aforementioned problems. In the preferred embodiment, a second grating structure 23 is provided so as to alleviate high levels of hydraulic backwater within the channel 21. The grating 23 is preferably of a finer pitch than the grating 23 so as to provide for much finer screening. Further, the grating 22 is preferably arranged tangentially to the main flow raised off the floor of the channel so that it receives a high level of utilisation only during peak periods. The grating 23 outputs to a channel 24 which can again join the channel 21 downstream of the grating 22. In this manner, the arrangement 20 can be utilised so as to retrofit a standard channel such that it is capable of dealing with intermittent high volume flows.

The grating 23 is further preferably of a modular form such that it can be inserted in a wall of the channel 21.

Of course, other arrangements are possible. For example, multiple gratings 23 could be inserted in the wall of the channel 21 each outputting to the channel 24. A further arrangement could comprise utilising multiple channels 24, for example, on one side the channel 21, with the gratings outputting to the channel 24.

Figure 3:
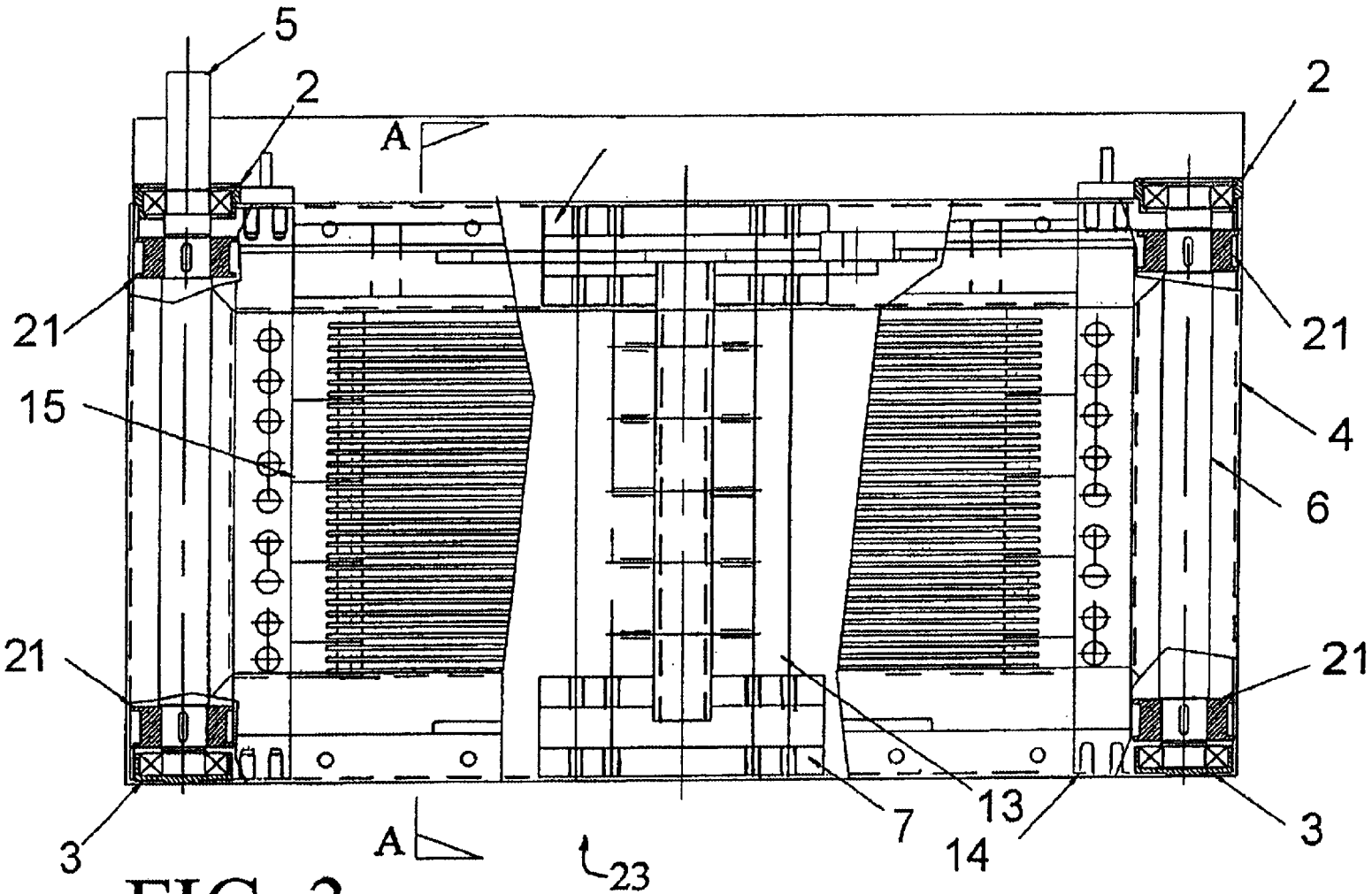
FIG. 3 illustrates a side elevation view of the preferred embodiment.
Figure 4:
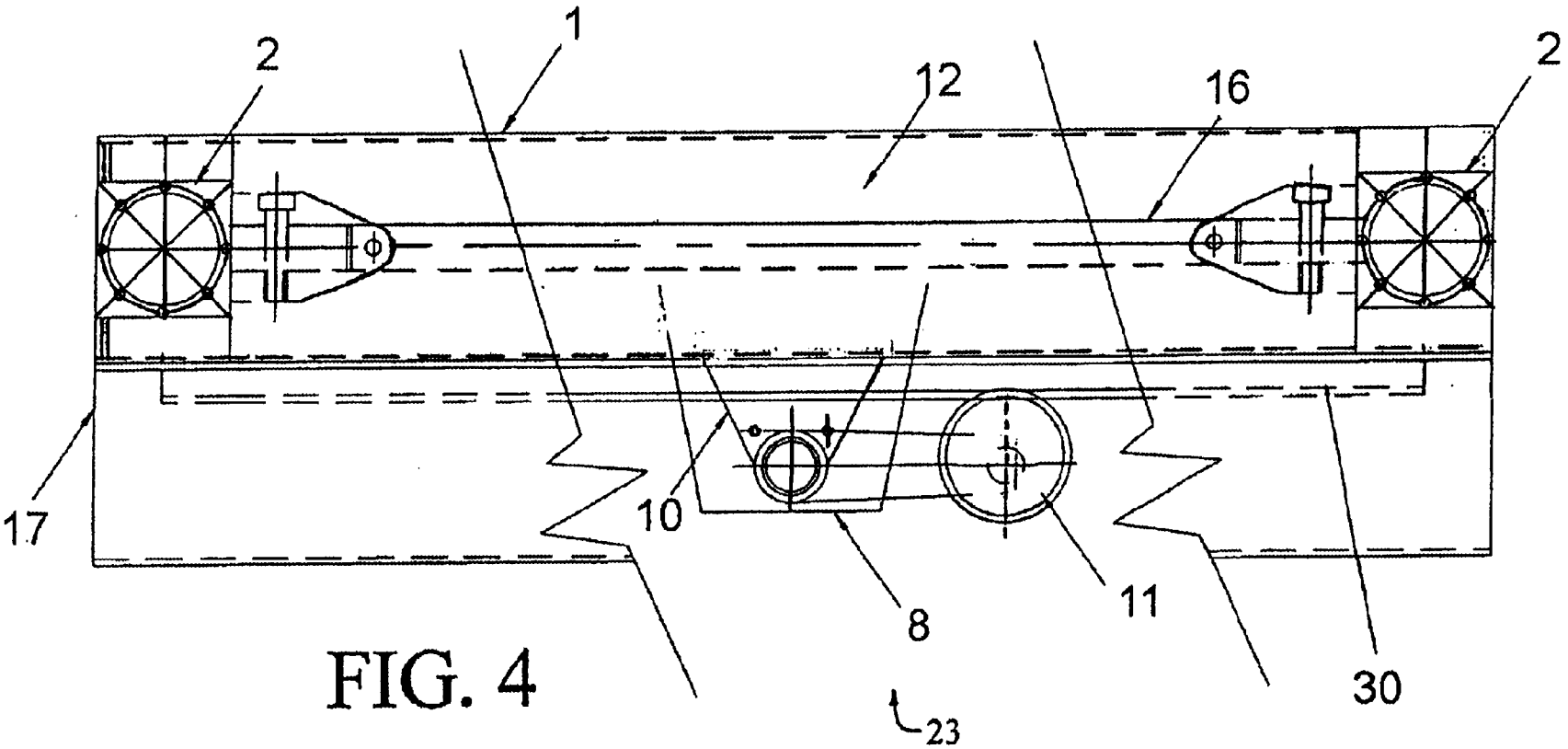
FIG. 4 illustrates a top plan view of the preferred embodiment.
Figure 5:
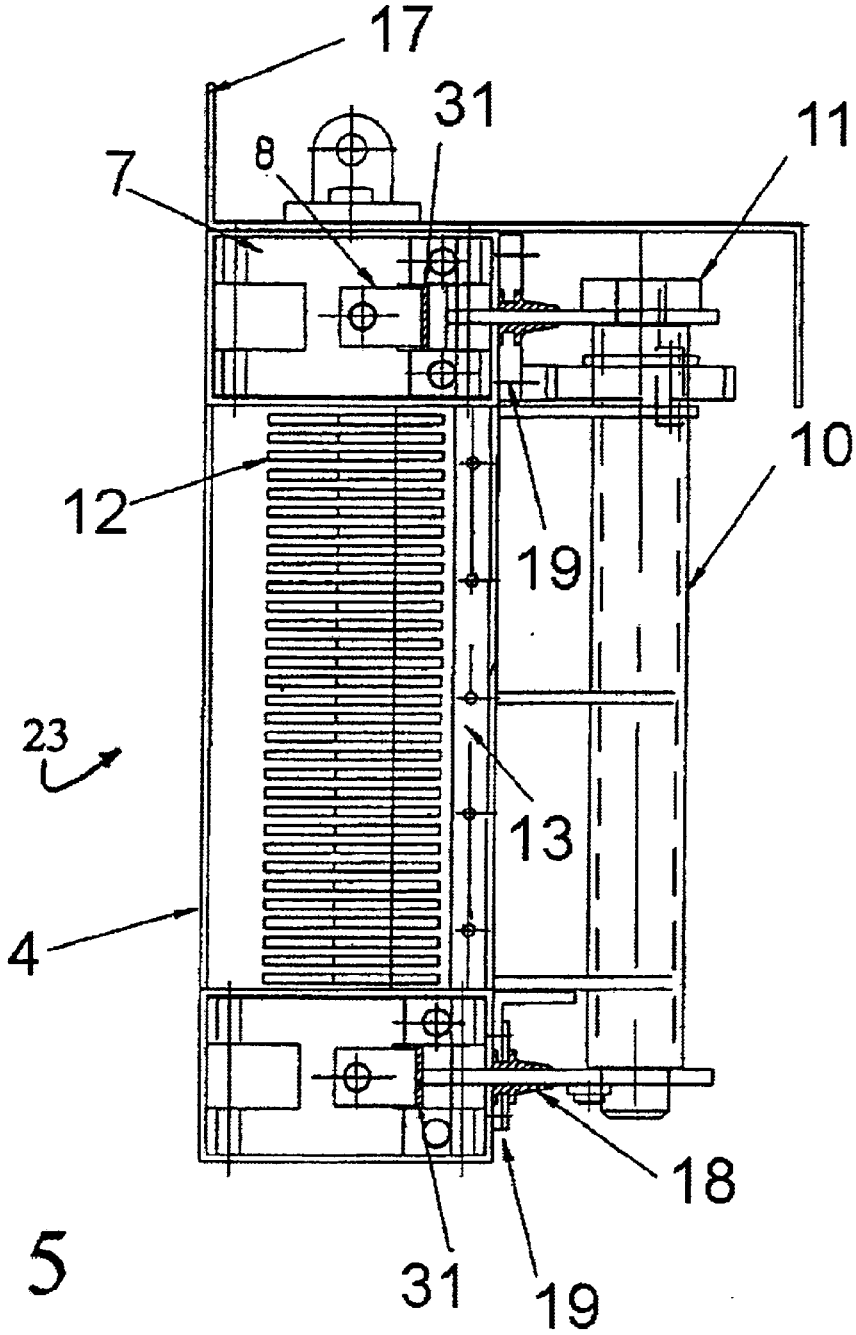
FIG. 5 illustrates a end plan view of the preferred embodiment.

Turning now to FIG. 3 to FIG. 5, there is illustrated various more detailed views of a single grating structure 23. FIG. 3 illustrates a side elevation view (looking from the channel of FIG. 1), FIG. 4 illustrates a top plan view and FIG. 5 illustrates a sectional view through the line A—A of FIG. 3 view. The grating 23 includes a series of spaced apart slats 16 which are fixed in end blocks e.g. 15 and form the core of the grating. The grating 23 includes a raking structure 7 which is designed to dislodge and clear material stuck to the slats 16 by means of a series of tynes 12 which traverse the slats so as to provide for clearance. The raking structure 7 is driven back and forth along the slats by means of a motorised shaft 5 which rotates and includes a belt drive which is attached to the shaft 5 in addition to a second shaft 6 which forms the other end of the belt drive.

Intermittent of the two shafts 5 & 6 is the raking structure 7 which is interconnected to the belt drive 31 (not shown) and this movement is controlled via movement of the shaft 5.

The raking arrangement 7 can further be interconnected to two belt drives one inside a bottom portion of the frame and the second inside the top portion of the frame. Each of the belt drives are interconnected between shafts 6 and shafts 7 so as to drive the raking arrangement 7 back and forth along the slats 16 under the control of shaft 5.

The raking structure 8 includes an offset gear follower 11 (FIG. 4) which engages a matching gear rack (30) along the length of the screen, so that the tynes 12 can be rotated in and out of the slats 16. The oscillating movements of the tynes 12 are therefore totally controlled by offset hole position in the gear which engages its matching gear rack.

Hence, it will be evident that the preferred embodiment, provides for a screening system 23 having a frame with horizontal screen bars 16 laid on their side evenly pitched and tensioned with a raking tyne motion pushing any screenings collected off the screen bars. Further, the tynes 12 are arranged such that its motion is directly influenced by the off centre gear 11 in contact with the gear rake 30 in use to generate a locus while reciprocating backwards and forwards. The tynes and its support block are supported and guided by the sealed slider blocks located internally within the frame driven by a tooth timing belt or chain drive or inclined worm and thread type drive via the input shaft 5. The linear position of the raking tynes can be set by limit position switches within an electrical actuator directly fitted to the shaft 5. The torque applied via the electrical actuator can be set via a clutch mechanism within the actuator to suit operational requirements. The electric actuator can be located on the end of the shaft and is secured to a boss on the end of the frame.

The frame is located and secured along the length of the wall set at a relative position to the invert of the main channel. The frame is designed to cope with torsional and lateral loads applied in turn transferred to the wall or ancillary supports.

The electrical actuator that drives the shaft 5 is located and is attached via the bearing housing 2. The actuator is readily available from several manufacturers, most notably Rotork.

It will be obvious to those skilled in the art that the operation of the preferred embodiment has direct application to many different fields where screening of fluids is required. For example, the following lists comprises a few of the applications of the present invention which will be readily apparent to those skilled in the art.

Water and Wastewater

Screening Coarse objects and dissipation of Kinetic Energy plus sand and grit arresting.

Storm Overflow

Coarse objects and dissipation of Kinetic Energy

Dams & reservoirs

Coarse objects and dissipation of Kinetic Energy

Construction

Screening Coarse objects and dissipation of Kinetic Energy

Forestry

Screening Coarse objects and dissipation of Kinetic Energy

Mining

Screening Coarse objects and dissipation of Kinetic Energy

Food

Screening Coarse objects and dissipation of Kinetic Energy

Military

Coarse objects and dissipation of Kinetic Energy

Agriculture

Screening Coarse objects and dissipation of Kinetic Energy

Hazardous Gas locations

Screening Coarse objects and dissipation of Kinetic Energy

It can be readily evident that small or large screens can be utilised to satisfy the regulations in force in each country.

Further, as an added safety feature, the preferred embodiment can be provided with a stopboard located in front of the screen to allow the screen to be removed for maintenance without disruption to the processes in place.

Preferably, the raking tynes are actuated upon detection of fluid within channel 21 so as to be driven back and forth along the slats 16 during periods when the grate 22 is experiencing a high load.

Turning again to FIGS. 1 & 2, the utilisation of the raking tynes provides for the ability to eject material caught on the grill 23 substantially clear of screenings and to provide for an overflow mechanism during periods of high utilisation.

The preferred embodiment provides for the use of a completely self contained electrical drive actuator that can be located in a suitable position without compromising the operation of the screen.

It will be evident that the screen is completely self contained and can be located in a suitable position without spending large amounts of capital money and can be simply removed and replaced when required for servicing. It would be appreciated by a person skilled in the art that numerous variations and/or modifications may be made to the present invention as shown in the specific embodiment without departing from the spirit or scope of the invention as broadly described. The present embodiment is, therefore, to be considered in all respects to be illustrative and not restrictive.

We claim:

1. A method of dealing with an overflow capacity of a fluid screening system, said system including a first screen for screening objects of a first predetermined size from a fluid channel, said method comprising the step of:

providing an ancillary screening system upstream of said first screen and operational upon fluid within said channel reaching a predetermined limit, said ancillary screening system screening objects less than a second predetermined size from said fluid channel wherein objects greater than said second predetermined size continue along said fluid channel so as to be collected and screened by said first screening system.

2. A method as claimed in claim 1 wherein said ancillary screening system includes a screen placed substantially tangentially to the main flow of fluid within said fluid channel.

3. A method as claimed in claim 1 wherein said ancillary screening system includes a raking mechanism for clearing objects lodged substantially adjacent said ancillary screening system.

4. A method as claimed in claim 1 wherein the output of said ancillary screening system is interconnected to said fluid channel downstream of said first screen.

5. An ancillary screening apparatus for screening an overflow capacity of a screening system, said system including a screen for screening objects of a first predetermined size from a fluid channel, said ancillary screening apparatus including:

a screening means including a second screen for screening objects less than a second predetermined size from said fluid channel upon fluid within said channel reaching a predetermined limit, whilst objects greater than said second predetermined size continue along said fluid channel so as to be collected and screened by said first screening system.

6. An ancillary screening apparatus as claimed in claim 5 wherein said ancillary screening system includes a raking mechanism adapted to rake said second screen so as to clear objects caught in said second screen.

7. An ancillary screening apparatus as claimed in claim 6 wherein said screen comprises a series of spaced apart slats and said raking mechanism includes a series of tynes between said spaced apart slats.

8. An ancillary screening apparatus as claimed in claim 7 wherein said tynes are driven in a reciprocating manner between said slats.

9. An ancillary screening apparatus as claimed in claim 7 wherein said raking mechanism includes a reciprocating means comprising a gear with a hole offset from the gear center which rotates along a mating gear rack located parallel to the said slats.

10. An ancillary screening apparatus as claimed in claim 6 wherein said raking mechanism is located downstream of said second screen.

11. An ancillary screening apparatus as claimed in claim 6 wherein said ancillary screening apparatus is adapted to be located with said second screen being substantially tangential to the main flow of fluid within said fluid channel.

* * * * *

UNITED STATES PATENT AND TRADEMARK OFFICE

CERTIFICATE OF CORRECTION

PATENT NO. : 6,679,994 B1 
DATED : January 20, 2004
INVENTOR(S) : Joe Turco, Eugene Turco and Ross Douglas Vernon King It is certified that error appears in the above-identified patent and that said Letters Patent is hereby corrected as shown below:

Title page,
Item [75], Inventors, for inventor Eugene Turco, please delete the following address: "45 Pinetree Drive, Carlingford, New South Australia 2118 (AU)" and insert the following therefor: -- 45 Pinetree Drive, Carlingford, New South Wales 2118 (AU) --.

Column 8,
Lines 1-2, please delete the following: "claim 6" and insert therefor -- claim 5 --.

Signed and Sealed this

Sixth Day of July, 2004

JON W. DUDAS
*Acting Director of the United States Patent and Trademark Office*